US006843195B2

(12) United States Patent
Watabe et al.

(10) Patent No.: US 6,843,195 B2
(45) Date of Patent: Jan. 18, 2005

(54) OUTBOARD MOTOR STEERING SYSTEM

(75) Inventors: Hiroshi Watabe, Wako (JP); Hideaki Takada, Wako (JP); Yoshinori Masubuchi, Wako (JP); Hiroshi Mizuguchi, Wako (JP); Taiichi Otobe, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/755,341

(22) Filed: Jan. 13, 2004

(65) Prior Publication Data

US 2004/0139903 A1 Jul. 22, 2004

(30) Foreign Application Priority Data

Jan. 17, 2003 (JP) ..... 2003-010047
Feb. 26, 2003 (JP) ..... 2003-049862

(51) Int. Cl.[7] ..... B63H 25/00
(52) U.S. Cl. ..... 114/144 E; 114/144 R; 440/1
(58) Field of Search ..... 114/144 E, 144 R; 440/1, 2

(56) References Cited

U.S. PATENT DOCUMENTS 4,759,731 A * 7/1988 Uchida et al. ..... 440/1
5,253,604 A * 10/1993 Bohlin ..... 114/144 E
5,389,016 A * 2/1995 Nestvall ..... 440/1
6,336,833 B1 * 1/2002 Rheault et al. ..... 440/1

FOREIGN PATENT DOCUMENTS

JP 62-125996 6/1987
JP 02-279495 11/1990

OTHER PUBLICATIONS

U.S. patent application Ser. No. 10/732,464, Mizuguchi et al., filed Dec. 11, 2003.

* cited by examiner

*Primary Examiner*—Lars A. Olson
(74) *Attorney, Agent, or Firm*—Westerman, Hattori, Daniels & Adrian, LLP

(57) ABSTRACT

In an outboard motor steering system for an outboard motor mounted on a stern of a boat and having an internal combustion engine at its upper portion and a propeller with a rudder at its lower portion powered by the engine to propel and steer the boat, a controller is connected to an actuator to rotate the outboard motor relative to the boat, and controls the actuator in such a manner that steered angle of the outboard motor relative to a steering angle inputted through a steering wheel becomes a predetermined ratio that is changed such that the steered angle of the outboard motor relative to the steering angle decreases with increasing moving speed of the boat. Alternatively, a switch is provided to be manipulated by the operator and generating a signal indicative of an instruction to change the steered angle of the outboard motor when manipulated; and the controller controlling the actuator to steer the outboard motor to an angle in response to inputted steering angle when the switch is not manipulated, while controlling the actuator to change the steered angle when the switch is manipulated. With this, the burdens of the operator are lightened and the steering feel is improved, in particular when the operator steers the boat to approach or leave a quay.

9 Claims, 13 Drawing Sheets

OUTBOARD MOTOR STEERING SYSTEM

BACKGROUND OF THE INVENTION

1. Field of the Invention

This invention relates to an outboard motor steering system.

2. Description of the Related Art

It is preferable for the operator that outboards (boats powered by outboard motors) can turn quickly in response to a sharp steering when approaching or leaving a quay at a low speed. Since, however, sharp turning at a high speed is not desirable in the sense of stability, it has been taught in Japanese Laid-Open Patent Application No. Hei 2 (1990)-279495, to provide a mechanical stopper that defines a maximum steered angle and to operate it in response to accelerator such that the maximum steered angle when the outboard is at a high speed is set to be smaller than that when the outboard is at a low speed.

However, in this prior art, since the speed of steering is not taken into account in setting the maximum steered angle, the operator must still operate a steering wheel slowly and carefully when the outboard moves at a high speed. In particular, the operator must pay more careful attention to the steering so as not to operate the steering wheel sharply due to rocking under high waves. Nevertheless, the operator must operate the steering wheel sharply when he or she approaches or leaves a quay at a small speed. Further, at the time of approaching a quay, the operator ordinarily operates the steering wheel in a direction such that the outboards moves toward the quay and then operates it in the opposite direction to stop the boat just at the quay.

Thus, the operator must operate the steering wheel carefully at the time of approaching or leaving a quay and tends to have an unpleasant steering "feel" owing to these burdens.

SUMMARY OF THE INVENTION

An object of the present invention is therefore to overcome the foregoing issues by providing an outboard motor steering system that can lighten the burdens of the operator and improve the steering feel, in particular when the operator steers the boat to approach or leave a quay.

In order to achieve the foregoing object, this invention provides, in its first aspect, a steering system for an outboard motor mounted on a stern of a boat and having an internal combustion engine at its upper portion and a propeller with a rudder at its lower portion powered by the engine to propel and steer the boat, comprising: a steering device installed on the boat to be manipulated by an operator; a swivel shaft installed in the outboard motor and connected to the propeller to turn the propeller relative to the boat; an actuator installed in the outboard motor and connected to the swivel shaft to rotate the swivel shaft relative to the boat; a steering angle sensor generating a signal indicative of a steering angle inputted through the steering device by the operator; a steered angle sensor generating a signal indicative of a steered angle of the outboard motor; a speed sensor generating a signal indicative of a moving speed of the boat; and a controller connected to the actuator, the steering angle sensor, the steered angle sensor and the speed sensor, and controlling the actuator in such a manner that the steered angle of the outboard motor relative to the steering angle becomes a predetermined ratio determined based on the moving speed of the boat.

In order to achieve the foregoing object, this invention provides, in its second aspect, a steering system for an outboard motor mounted on a stern of a boat and having an internal combustion engine at its upper portion and a propeller with a rudder at its lower portion powered by the engine to propel and steer the boat, comprising: a steering device installed on the boat to be manipulated by an operator; a swivel shaft installed in the outboard motor and connected to the propeller to turn the propeller relative to the boat; an actuator installed in the outboard motor and connected to the swivel shaft to rotate the swivel shaft relative to the boat; a steering angle sensor generating a signal indicative of a steering angle inputted through the steering wheel by the operator; a switch to be manipulated by the operator and generating a signal indicative of an instruction to change the steered angle of the outboard motor when manipulated; and a controller connected to the actuator, the steering angle sensor and the switch, and controlling the actuator to rotate the swivel shaft so as to steer the outboard motor to an angle in response to inputted steering angle when the switch is not manipulated, while controlling the actuator to change the steered angle when the switch is manipulated.

BRIEF DESCRIPTION OF THE DRAWINGS

The above and other objects and advantages of the invention will be more apparent from the following description and drawings, in which.

DETAILED DESCRIPTION OF THE PREFERRED EMBODIMENTS

An outboard motor steering system according to a first embodiment of the present invention will now be explained with reference to the attached drawings.

Figure 1:
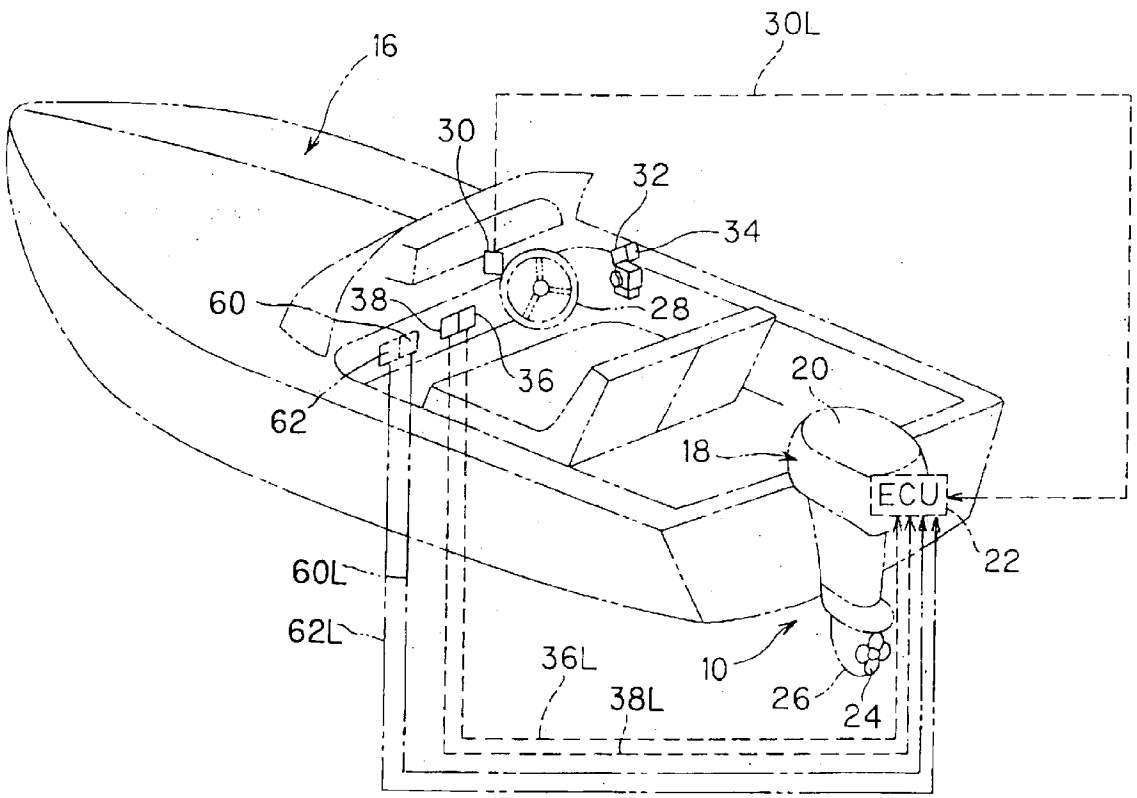
FIG. 1 is an overall schematic view of an outboard motor steering system according to a first embodiment of the invention.
Figure 2:
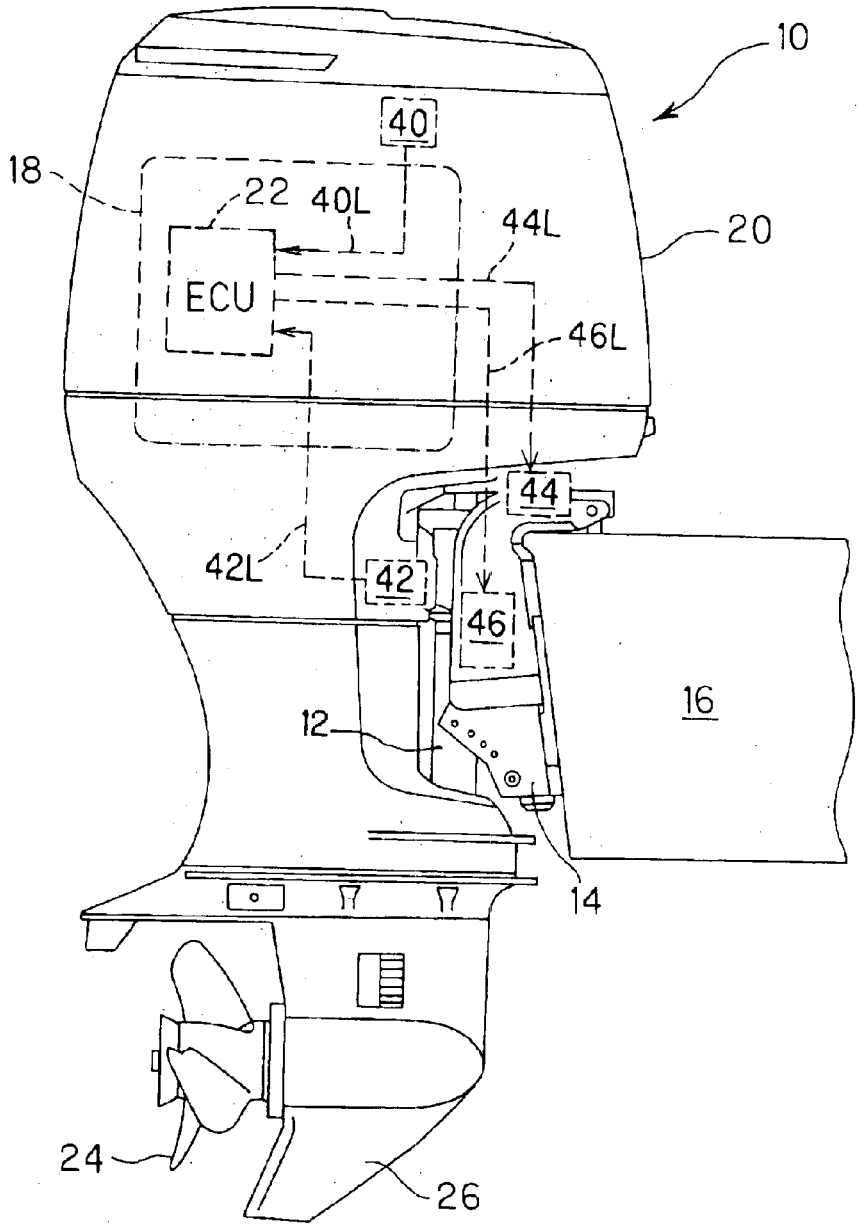
FIG. 2 is an explanatory side view of a part including an outboard motor of FIG. 1.

FIG. 1 is an overall schematic view of the outboard motor steering system, and FIG. 2 is an explanatory side view of a part including an outboard motor of FIG. 1.

Reference numeral 10 in FIGS. 1 and 2 designates an outboard motor built integrally of an internal combustion engine, propeller shaft, propeller and other components. As illustrated in FIG. 2, the outboard motor 10 is mounted on the stern of a boat (hull) 16 via a swivel case 12 (that rotatably accommodates or houses a swivel shaft (not shown)) and stern bracket 14 (to which the swivel case 12 is connected), to be rotatable about the vertical and horizontal axes.

As shown in FIG. 2, the outboard motor 10 is equipped with an internal combustion engine 18 at its upper portion. The engine 18 is a spark-ignition, in-line four-cylinder gasoline engine with a displacement of 2,200 cc. The engine 18, located inside the outboard motor 10, is enclosed by an engine cover 20 and positioned above the water surface. An electronic control unit (ECU) 22 constituted of a microcomputer is installed near the engine 18 enclosed by the engine cover 20.

The outboard motor 10 is equipped at its lower part with a propeller 24 and a rudder 26 adjacent thereto. The rudder 26 is fixed near the propeller 24 and does not rotate independently. The propeller 24, which operates to propel the boat 16 in the forward and reverse directions, is powered by the engine 18 through a crankshaft, drive shaft, gear mechanism and shift mechanism (none of which is shown).

As shown in FIG. 1, a steering wheel (steering device) 28 is installed near the operator's seat of the boat 16. A steering angle sensor 30 is installed near the steering wheel 28. The steering angle sensor 30 is made of a rotary encoder and outputs a signal in response to the turning of the steering wheel 28 inputted by the operator. A throttle lever 32 and a shift lever 34 are mounted on the right side of the operator's seat. Operations inputted to these are transmitted to a throttle valve and the shift mechanism (neither shown) of the engine 18 through push-pull cables (not shown).

A power tilt switch 36 for regulating the tilt angle and a power trim switch 38 for regulating the trim angle of the outboard motor 10 are also installed near the operator's seat. These switches output signals in response to tilt-up/down and trim-up/down instructions inputted by the operator. The outputs of the steering angle sensor 30, power tilt switch 36 and power trim switch 38 are sent to the ECU 22 over signal lines 30L, 36L and 38L.

As illustrated in FIG. 2, a crank angle sensor 40 is installed at a position near the crankshaft (not shown) of the engine 18 and generates pulse signals including a crank pulse signal produced once every predetermined crank angles (e.g., 30 degrees). A steered angle sensor 42 is installed at a position near the swivel shaft (not shown) rotatably accommodated in the swivel case 12 and generates a pulse signal each time when the swivel shaft is rotated by one degree (i.e., each time when the outboard motor 10 is steered by one degree). The outputs of the sensors 40, 42 are sent to the ECU 22 over signal lines 40L and 42L. Further, around the swivel case 12 and the stern bracket 14, there are installed various steering actuators including an electric motor 44 and a conventional power tilt-trim unit 46 to regulate the tilt angle and trim angle of the outboard motor 10, that are connected to the ECU 22 through signal lines 44L and 46L.

In response to the outputs of these sensors and switches, the ECU 22 operates the electric motor 44 to steer the outboard motor 10, and operates the power tilt-trim unit 46 to regulate the tilt angle and trim angle of the outboard motor 10.

Figure 3:
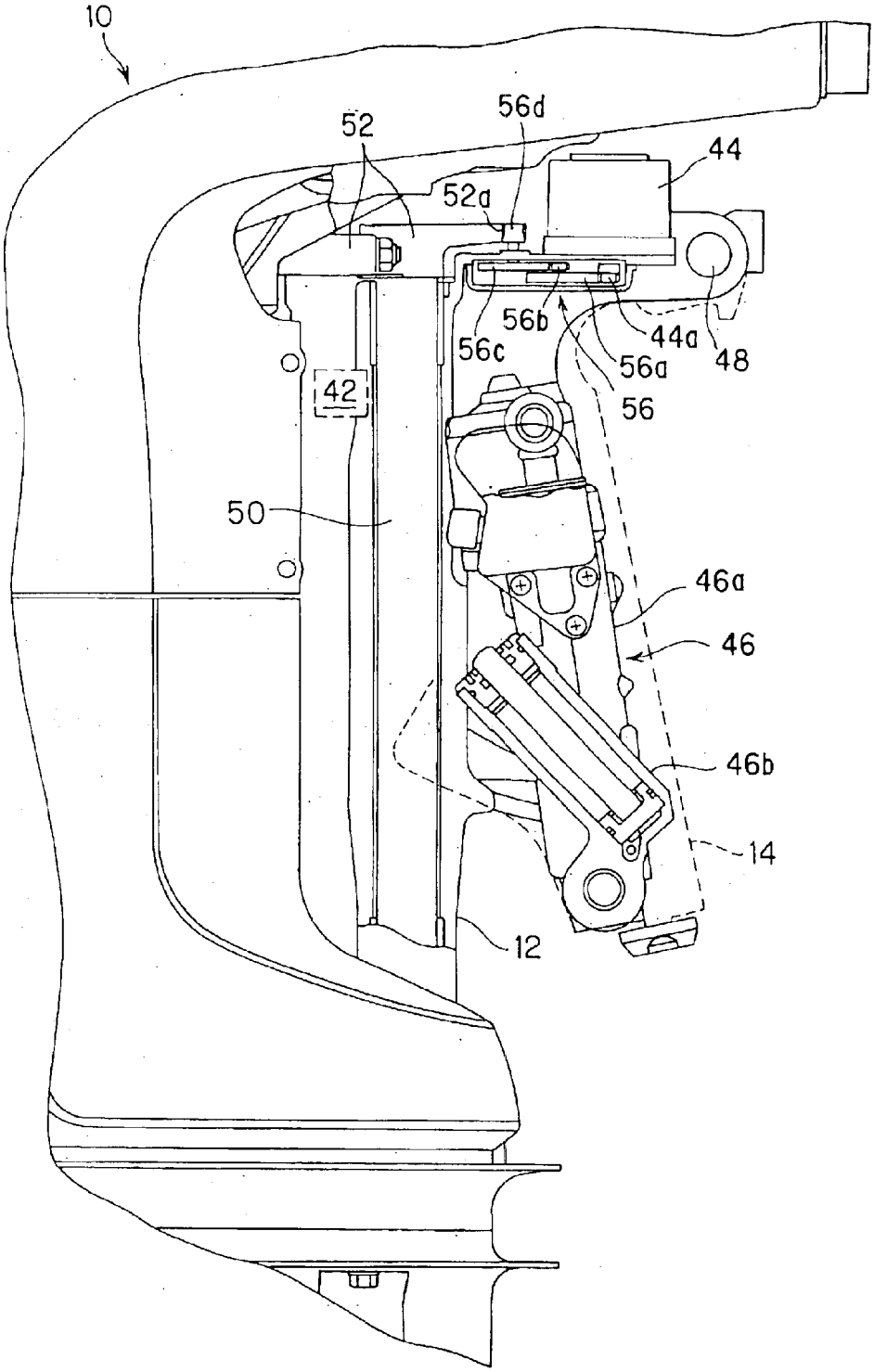
FIG. 3 is an enlarged partial side view of a part of FIG. 2.

FIG. 3 is an enlarged partial side view of FIG. 2 and shows the structure around the swivel case 12 of the outboard motor 10.

As illustrated in FIG. 3, the power tilt-trim unit 46 is equipped with one hydraulic cylinder 46*a* for tilt angle regulation and, constituted integrally therewith, two hydraulic cylinders 46*b* for trim angle regulation (only one shown). One end (cylinder bottom) of the tilt hydraulic cylinder 46*a* is fastened to the stern bracket 14 and through it to the boat 16 and the other end (piston rod head) thereof abuts on the swivel case 12. One end (cylinder bottom) of each trim hydraulic cylinder 46*b* is fastened to the stern bracket 14 and through it to the boat 16, similarly to the one end of the tilt hydraulic cylinder 46*a*, and the other end (piston rod head) thereof abuts on the swivel case 12.

The swivel case 12 is connected to the stern bracket 14 through a tilting shaft 48 to be relatively displaceable about the tilting shaft 48. In other words, the swivel case 12 is connected to the boat 16 to be displaceable to each other about the tilting shaft 48. As mentioned above, the swivel shaft (now assigned with reference numeral 50) is rotatably accommodated inside the swivel case 12. The swivel shaft 50 extends in the vertical direction and has its upper end fastened to a mount frame 52 and its lower end fastened to a lower mount center housing (not shown). The mount frame 52 and lower mount center housing are fastened to a frame on which the engine 18 and the propeller 24, etc., are mounted.

The electric motor 44 and a gearbox (gear mechanism) 56 for reducing the output of the electric motor 44 are fastened to an upper portion above the swivel case 12.

Figure 4:
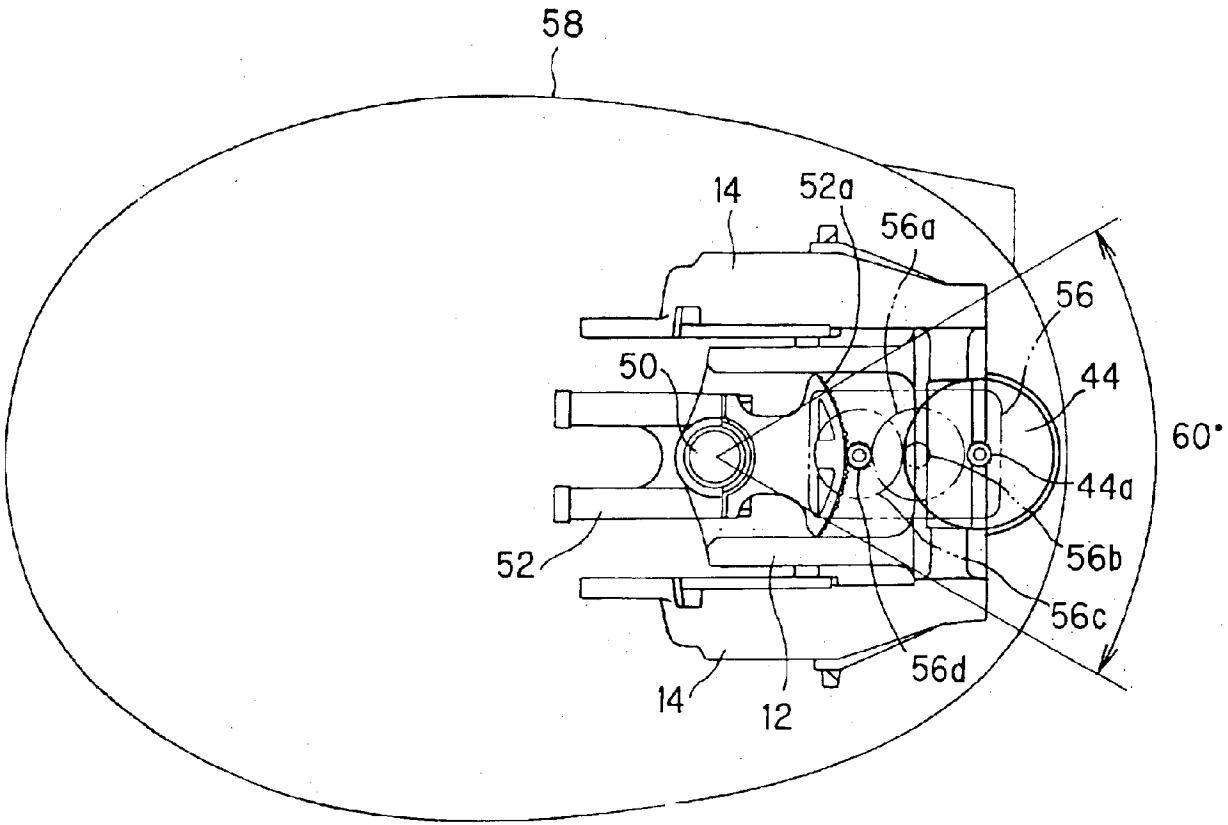
FIG. 4 is a cross-sectional view taken along the line IV—IV of FIG. 3.

FIG. 4 is a cross-sectional view and is also an explanatory plan view looking down from above (downward in the gravitational direction) showing the electric motor 44, swivel case 12, mount frame 52 and gearbox 56. Reference numeral 58 in FIG. 4 designates the vertical projection plane of the profile of the outboard motor 10 in plan view.

As shown in FIGS. 3 and 4, the electric motor 44 is fixed to the swivel case 12 inside the outboard motor 10 (within the vertical projection plane 58 of the profile of the outboard motor 10) and is connected to the mount frame 52 through the gearbox 56 similarly fixed inside the outboard motor 10.

Specifically, inside the gearbox 56, an output shaft gear 44*a* fastened on the output shaft of the electric motor 44 meshes with a first gear 56*a* of larger diameter (having more teeth) than the output shaft gear 44*a*. A second gear 56*b* of smaller diameter (having fewer teeth) than the first gear 56*a* is fastened to the first gear 56*a* coaxially therewith, and the second gear 56*b* meshes with a third gear 56*c* of larger diameter. A fourth gear 56*d* of smaller diameter than the third gear 56*c* is fixed coaxially therewith outside the gearbox 56.

A mount frame gear 52*a* of larger diameter than the fourth gear 56*d* is formed on an arcuate end face of the mount frame 52. The fourth gear 56*d* meshes with the mount frame gear 52*a* to transmit the geared-down output of the electric motor 44 to the mount frame 52 and to rotate the swivel shaft 50. Horizontal steering of the outboard motor 10 is thus power-assisted using the rotational output of the electric motor 44 to swivel the mount frame 52 to rotate the swivel shaft 50 and thus turns the propeller 24 and rudder 26 about the vertical axis. The overall rudder turning angle (steerable angle) of the outboard motor 10 is 60 degrees, 30 degrees to the right and 30 degrees to the left.

Figure 5:
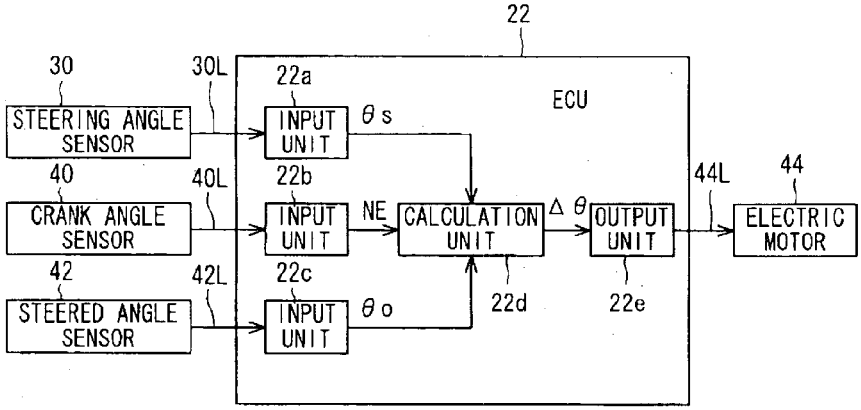
FIG. 5 is a block diagram showing the configuration of the outboard motor steering system according to the first embodiment.

FIG. 5 is a block diagram showing the configuration of the outboard motor steering system according to the first embodiment.

As illustrated in the figure, the ECU 22 inputs, via an input unit 22*a*, the output (pulse signal) generated by the steering angle sensor 30 and sent over the signal line 30L, and counts the number of the outputs to detect or determine the steering angle (turning angle) θs of the steering wheel 28. In addition, the ECU 22 inputs, via input units 22*b* and 22*c*, the output (crank pulse signal) generated by the crank angle sensor 40 and sent over the signal line 40L and the output (pulse signal) generated by the steered angle sensor 42 and sent over the signal line 42L, and counts the number of the outputs respectively to detect or determine the engine speed NE and the steered angle (rudder angle) θo of the outboard motor 10.

The detected steering angle θs of the steering wheel 28, the engine speed NE and the steered angle θo of the outboard motor 10 are inputted to a calculation unit 22*d*. The calculation unit 22*d* calculates a desired steered wheel θod based on the detected steering angle θs and engine speed NE as will be explained later in detail, calculates a current supply command value based on a difference AO between the desired steered angle θod and the detected θo, and outputs and supplies the command to the electric motor 44 through an output unit 22*e* and the signal line 44L.

The operation of the outboard motor steering system according to the first embodiment of the invention, more specifically, the operation to calculate a desired steered angle of the outboard motor 10 will be explained with reference to a flow chart of FIG. 6. The program illustrated there is started when the ignition switch (not shown) is turned to the ACC position and thereafter, is executed at prescribed intervals of, for example, 100 msec.

It should be noted here that the steering wheel 28 can turn four times between lock-to-lock positions and its central position (neutral position) is made equal to a straightforward direction of the boat 16, i.e., the propeller 24 and the rudder 26 of the outboard motor 10 moves the boat 16 straightforward when the steering wheel 28 is not turned right or left.

Figure 6:
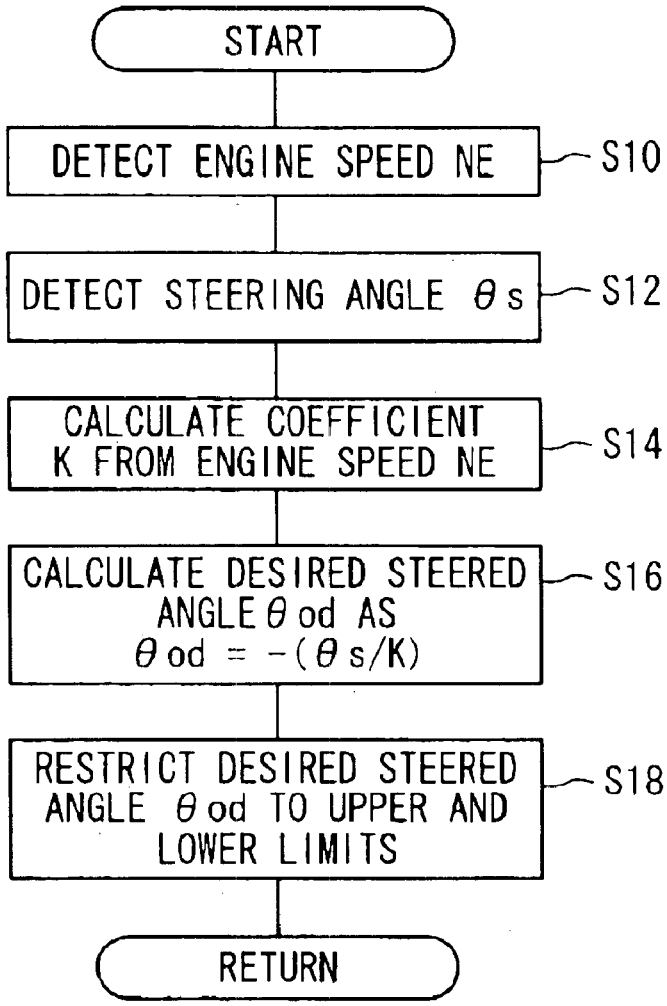
FIG. 6 is a flow chart showing the operation of the outboard motor steering system according to the first embodiment, more specifically, the operation to calculate a desired steered angle of the outboard motor of FIG. 1.

The program of the flow chart shown in FIG. 6 begins in S10 in which the engine speed NE is detected (detected engine speed NE is read out). Since the moving speed of the boat 16 is considered to be proportional to the engine speed NE, it is treated in this embodiment that the engine speed NE indicates the boat moving speed.

The program then proceeds to S12 in which the steering angle θs of the steering wheel 28 is detected (detected angle is read out). The values of the detected steering angle θs, the detected steered angle θo and the desired steered angle θod are assigned with sign (+/−) dependent on a direction in which the steering wheel 28 or swivel shaft 50 (rudder 26) is turned.

Figure 7:
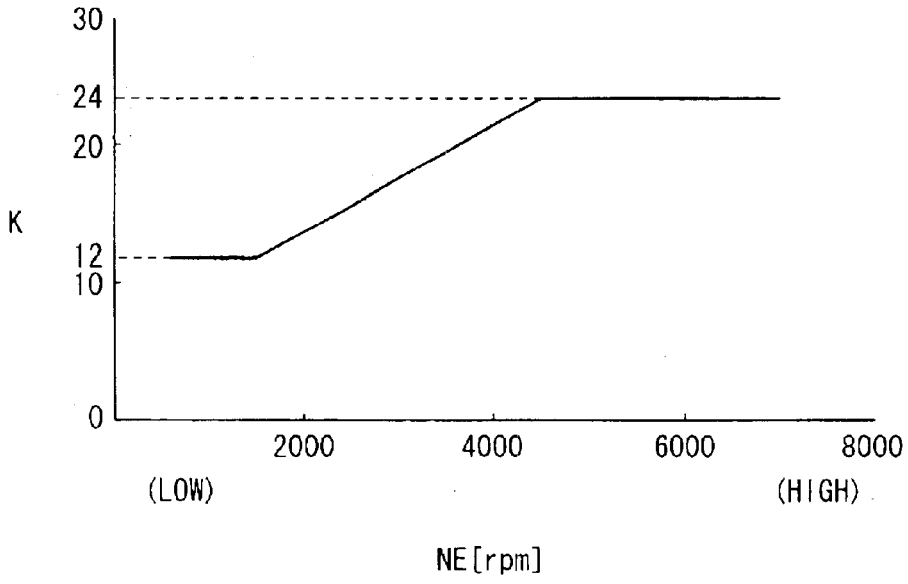
FIG. 7 is a graph showing characteristic of table data of a coefficient K to be used in the processing of the flow chart of FIG. 6.

The program then proceeds to S14 in which a coefficient K is calculated by retrieving table data (whose characteristic is shown in FIG. 7) using the detected engine speed NE as address data. As shown in FIG. 7, the coefficient K is set to be increased with increasing engine speed NE, in other words, it increases with increasing boat moving speed.

The program then proceeds to S16 in which the desired steered angle θod is calculated or determined by dividing the detected steering angle θs by the coefficient K and by reversing the sign of the obtained quotient (from + to − or from − to +). The coefficient K is thus a factor that determines a ratio of the desired steered angle θod to the steering angle θs. The reason why the sign of the desired steered angle θod is reversed is that, when the steering wheel 28 is, for example, turned to the right to steer the boat 16 in that direction, the outboard motor 10 must be turned in the opposite direction.

Since the coefficient K is set to be increased with increasing engine speed NE (boat moving speed), the desired steered angle θod of the outboard motor 10 relative to the steering angle θs of the steering wheel 28 is decreased with increasing engine speed NE (boat moving speed). Specifically, if the boat 16 moves, for example, at a low speed (low engine speed of 1500 [rpm]), the coefficient K is set to be 12. Accordingly, under such a low speed, the desired steered angle θod of the outboard motor 10 obtained by turning the steering wheel 28 by one rotation, is 30 degrees (=360 degrees/12). Since the maximum steerable angle is 30 degrees in right or left as mentioned above, it becomes possible to steer the outboard motor 10 to its maximum only if the steering wheel 28 is turned by one rotation (360 degree rotation) from the central position.

On the other hand, if the boat 16 moves at a high speed (high engine speed of e.g., 7000 [rpm]), the coefficient K is set to be 24. The desired steered angle θod of the outboard motor 10 obtained by turning the steering wheel 28 by one rotation, is 15 degrees (=360 degrees/24). As a result, in order to steer the outboard motor 10 to its maximum, the steering wheel 28 must be turned two rotations (720 degrees) from the central position.

In this control, thus, the response of steered angle of the outboard motor 10 relative to steering of the steering wheel 28 is set to be decreased with increasing boat moving speed, in other words, the speed of steering at a high boat moving speed is set to be made smaller than that at a low boat moving speed.

Continuing the explanation of the flow chart, the program then proceeds to S18 in which the calculated desired steered angle θod is restricted to upper and lower limits. As mentioned above, the steering wheel 28 can rotate two times from the central position in the right or left directions and can thus rotate four times between the lock-to-lock positions. However, the two-time rotation to achieve the maximum steered angle is only needed at the high boat speed. The amount of steering wheel rotation necessary for obtaining the maximum steered angle decreases as the boat moving speed decreases. Therefore, in S18, the calculated desired steered angle θod is compared with the upper and lower limits (that indicate a permissible range of angles at the boat moving speed) such that the calculated value remains with the limits.

Figure 8:
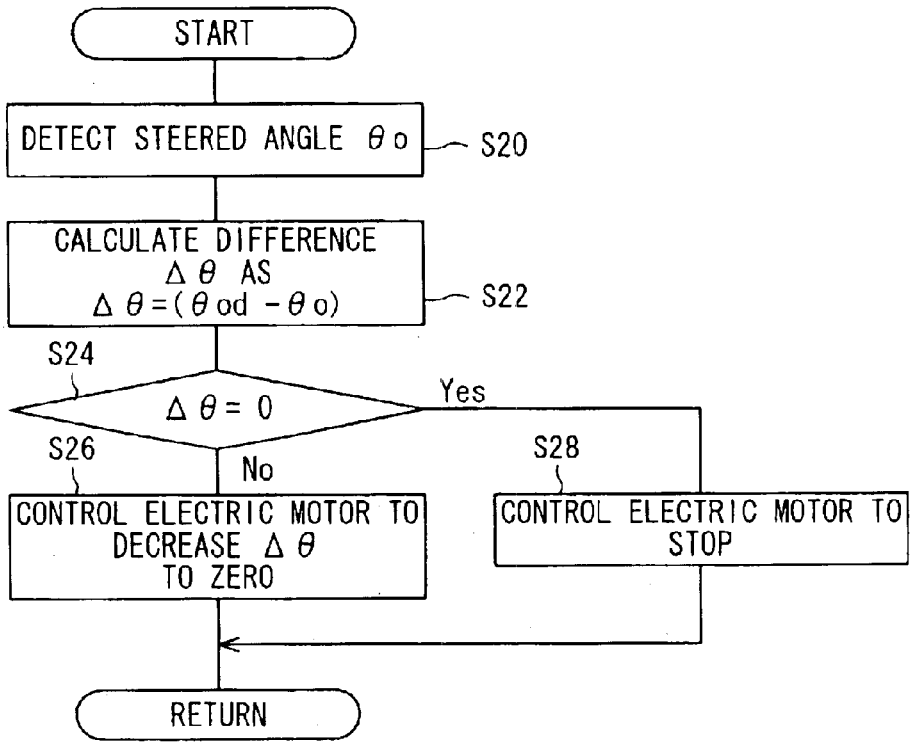
FIG. 8 is a flow chart showing another operation of the outboard motor steering system, more specifically, the operation to control an electric motor to steer the outboard motor using a difference between a detected steered angle and the desired steered angle calculated in the flow chart of FIG. 6.

Next, another operation of the outboard motor steering system, more specifically, the operation to control the electric motor 44 to steer the outboard motor 10 using a difference between the detected steered angle θo and the calcualted desired steered angle θod, will be explained with reference to FIG. 8. Similarly, the program illustrated in FIG. 8 is started when the ignition switch is turned to the ACC position and thereafter, is executed at prescribed intervals of, for example, 100 msec.

The program begins in S20 in which the steered angle θo of the outboard motor 10 is detected (detected angle is read out), and proceeds to S22 in which the steered angle θo just detected is subtracted from the desired steered angle θod (calculated in S16 in the flow chart of FIG. 6) to calculate the difference Δθ in a manner shown there.

The program then proceeds to S24 in which it is checked whether the calculated difference Δθ is zero. When the result in S24 is negative, the program proceeds to S26 in which the electric motor 44 is controlled to decrease Δθ to zero. Specifically, the current supply command value is calculated such that the difference Δθ decreases to zero, and supplies the calculated current supply command to the electric motor 44 through the output unit 22*e* and the signal line 44L to drive the same so as to rotate the swivel shaft 50 such that the outboard motor 10 is steered. On the other hand, when the result in S24 is affirmative, the program proceeds to S28 in which the electric motor 44 is controlled to stop at the current position such that the steered angle θo is held.

As stated above, the outboard motor steering system according to this embodiment is arranged such that it controls the operation of the electric motor 44 to steer the outboard motor 10 such that the steered angle θo (of the outboard motor 10 to be outputted) relative to the steering angle θs (inputted through the steering wheel 28) becomes a predetermined ratio determined based on the coefficient K, and that it changes the coefficient K based on the parameter (engine speed NE) indicative of the moving speed of the boat 16, thereby changing the ratio of the steered angle θo (i.e., the desired value (θod)) relative to the steering angle θs. With this, it becomes possible to steer the outboard motor 10 at an optimum speed in response to the moving speed of the boat 16, thereby lighting the burdens of the operator and hence, enabling to improve the steering feel.

More specifically, since the system is arranged such that the ratio of the steered angle θo (i.e., the desired value θod) relative to the steering angle θs is decreased with increasing boat moving speed (i.e., the engine speed NE), the operator can rotate the steering wheel 28 at a constant speed, regardless of the boat moving speed. With this, the outboard motor 10 can be steered sharply at a low speed, for example, when approaching or leaving a quay, whilst the outboard motor 10 can be steered slowly at a high speed to achieve a stable steering, thereby further lighting the burdens of the operator and hence, enabling to further improve the steering feel.

In addition, even if the steering angle is unintentionally made sharp and excessive at a high speed due to rocking under high waves, since the steered angle resulting in response thereto is relatively small at a high speed, this does not degrade the stability in steering.

Figure 9:
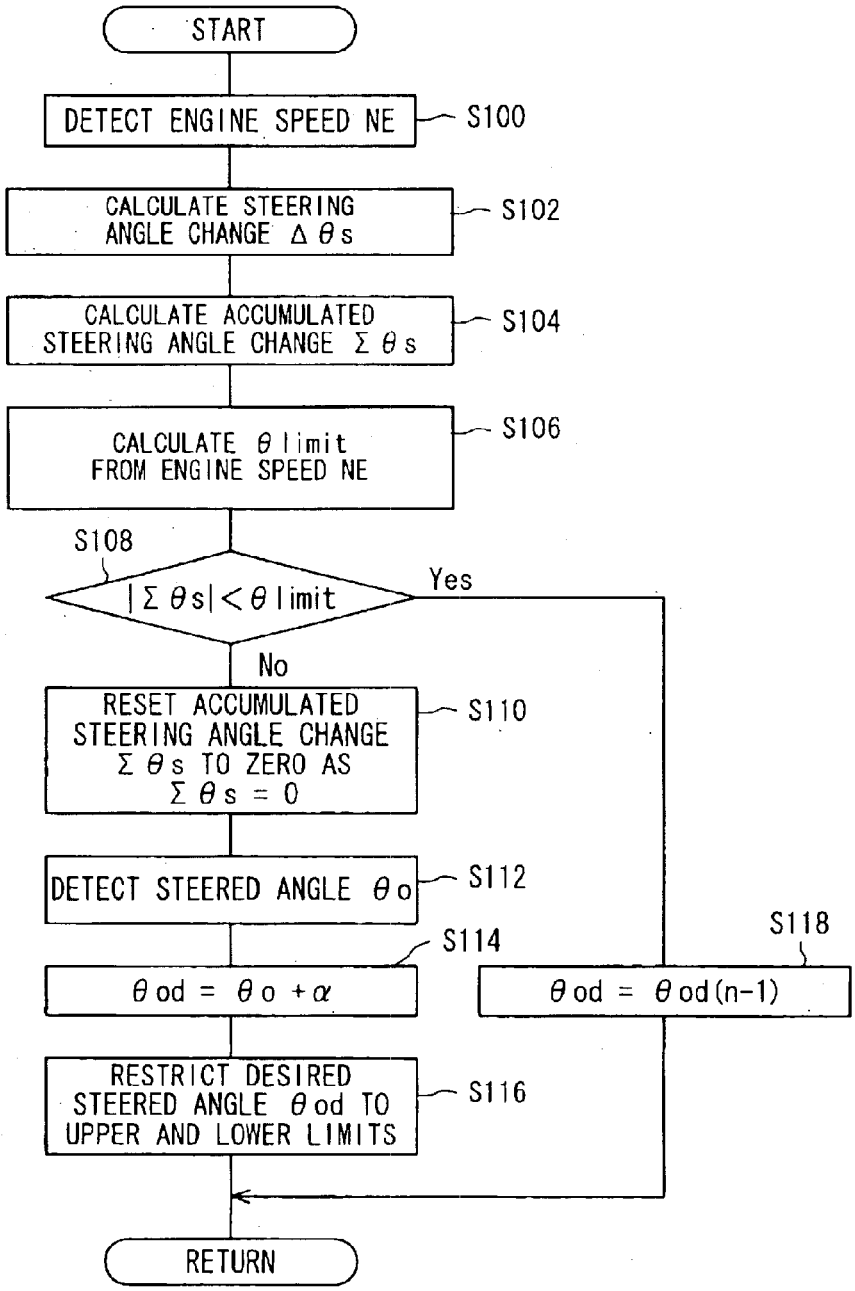
FIG. 9 is a flow chart, similar to FIG. 6, but showing the operation of an outboard motor steering system according to a second embodiment of the invention.

FIG. 9 is a flow chart, similar to FIG. 6, but showing the operation of an outboard motor steering system according to a second embodiment of the invention. The program illustrated there is also started when the ignition switch is turned to the ACC position and thereafter, is executed at prescribed intervals of, for example, 100 msec.

The system according to the second embodiment is based on a steering system in which the steering wheel 28 has no central position, i.e., the steering wheel 28 has no lock-to-lock positions.

Explaining this, the program begins in S100 in which the engine speed NE is detected and the program proceeds to S102 in which a steering angle change Δθs occurred since the last program loop of the flow chart is detected or calculated, and to S104 in which the calculated value is added to its accumulated past value to calculate an accumulated steering angle change Σθs since starting of the processing of the flow chart shown in FIG. 9. The value Δθs is also assigned with the sign (+/−) depending on the direction of steering wheel rotation.

Figure 10:
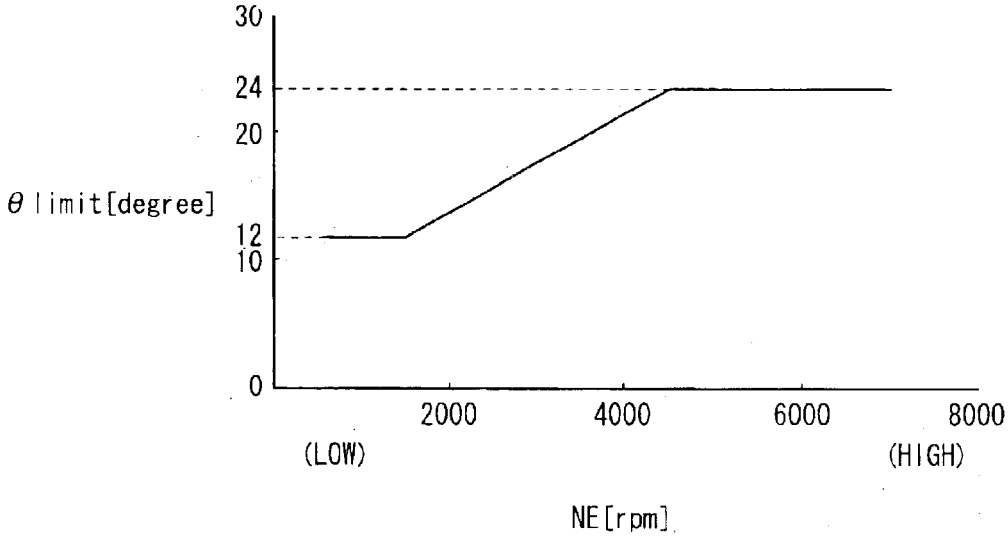
FIG. 10 is a graph showing characteristic of table data of a limit θlimit to be used in the processing of the flow chart of FIG. 9.

The program then proceeds to S106 in which a limit θlimit is calculated by retrieving table data (whose characteristic is shown in FIG. 10) using the detected engine speed NE as address data. As shown in FIG. 10, the limit θlimit is also set to be increased with increasing engine speed NE, in other words, it increases with increasing boat moving speed.

The program then proceeds to S108 in which it is determined if the calculated accumulated steering angle change Σθs is less, in absolute value, than the limit θlimit. When the result is negative, the program proceeds to S110 in which the calculated accumulated steering angle change Σθs is reset to zero, and to S112 in which the steered angle θo is detected. The program then proceeds to S114 in which the desired steered angle θod is calculated or determined by adding a predetermined angle α to the detected steered angle θo.

The angle α is also assigned with the sign opposite from that of the accumulated steering angle change Σθs and is set, in absolute value, to be 1 degree, for example. Specifically, when the accumulated steering angle change Σθs is a positive value, the value α is −1 degree, whereas when the change Σθs is a negative value, the value α is +1 degree. The reason why the sign is reversed is the same as that mentioned with reference to S16 in the flow chart of FIG. 6.

The program then proceeds to S116 in which the calculated desired steered angle θod is similarly restricted to upper and lower limits such that the calculated desired steered angle θod does not exceed the maximum steered angle and remains with the limits.

When the result in S108 is affirmative, the program proceeds to S118 in which the desired steered angle at the preceding or last time θod(n−1) is determined to be that at the current time. When the program of this flow chart is looped for the first time, the detected steered angle θo is immediately used as the desired steered angle θod.

Based on the desired steered angle θod thus determined, the ECU 22 controls the electric motor 44 to steer the outboard motor 10 in the same manner as that mentioned with reference to the flow chart of FIG. 8 in the first embodiment.

As stated above, in the system according to the second embodiment, when the accumulated turning amount of the steering wheel 28 has reached the limit θlimit, the outboard motor 10 is steered by the predetermined angle α. In other words, the outboard motor 10 is steered by a predetermined ratio (determined from the limit θlimit) relative to the steering angle θs.

Since the limit θlimit is set to be increased with increasing engine speed NE (boat moving speed), the desired steered angle θod relative to the steering angle θs is decreased with increasing engine speed NE (boat moving speed). Specifically, if the boat 16 moves at a low speed (when the engine speed NE is 1500 [rpm]), the limit θlimit is 12 degrees as shown in FIG. 10. This means that the outboard motor 10 turns by 1 degree when the steering wheel 28 is turned by 12 degrees. In other words, the outboard motor 10 can be steered to its maximum (30 degrees) at a low speed if the steering wheel 28 is turned by one rotation (360 degrees).

On the contrary, if the boat 16 moves at a high speed (when the engine speed NE is e.g., 7000 [rpm]), the limit θlimit is 24 degrees as shown in FIG. 10. This means that the outboard motor 10 turns by 1 degree when the steering wheel 28 is turned by 24 degrees. In other words, in order to steer the outboard motor 10 to its maximum (30 degrees) at a high speed, the steering wheel 28 must be turned by two rotations (720 degrees). Thus, the response of the steered angle relative to the steering angle of the steering wheel 28 is decreased with increasing boat moving speed. To be more specific, the speed of steered angle at a high boat moving speed is made smaller than that at a low boat moving speed.

With this, the system according to the second embodiment can have the same advantages and effects as those of the first embodiment, even if the steering wheel 28 has no central position, i.e., no lock-to-lock positions. The rest of the arrangement of the second embodiment is not different from that of the first embodiment.

Next, a steering system according to a third embodiment of the invention will be explained.

Explaining the points of difference from the first and second embodiments set out in the foregoing, in the system according to the third embodiment, a neutral switch 60 and a steered-direction reversal switch (steered-angle reversal switch) 62 are additionally installed near the operator's seat of the boat 16 to be manipulated by the operator, as shown by phantom lines in FIG. 1.

When the neutral switch 60 is turned on by the operator, it generates an ON signal indicating that an instruction is made by the operator to restore the steered direction to a neutral position (angle) such that the boat 16 advances straightforward. When the steered-direction-reversal switch 62 is turned on by the operator, it generates an ON signal indicating that an instruction is made by the operator to reverse the steered direction of the outboard motor 10 such that the boat 16 is steered to the reverse or opposite direction. Thus, the switches 60 and 62 are switches to be manipulated by the operator and generating a signal indicative of an instruction to, change the steered angle of the outboard motor 10, when manipulated by the operator. When the switches 60 and 62 are not manipulated by the operator, they generate OFF signals. The outputs of these switches 60, 62 are sent to the ECU 22 over signal lines 60L and 62L.

Figure 11:
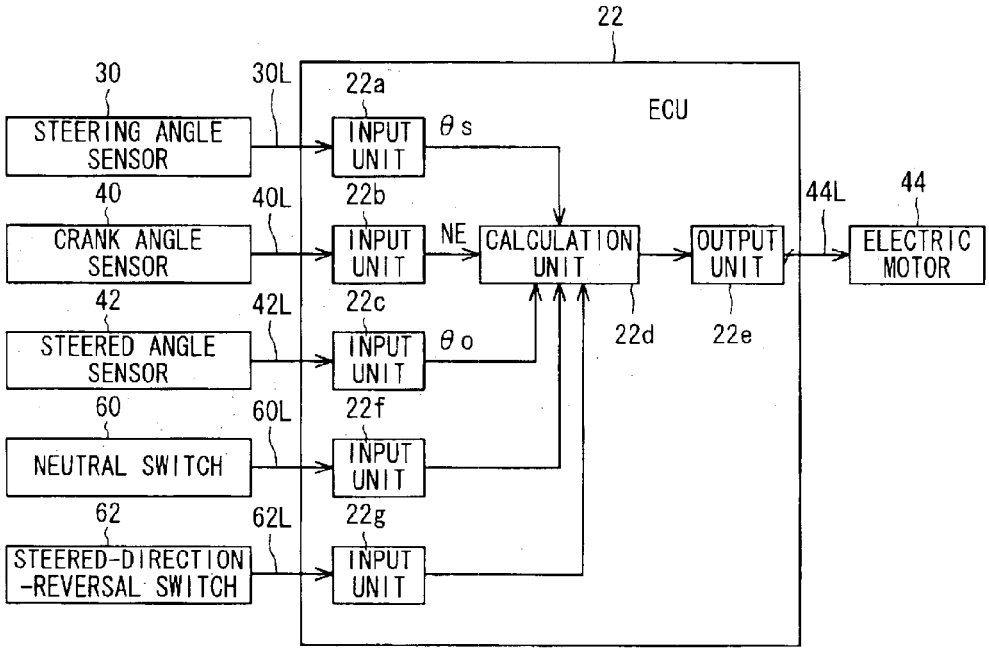
FIG. 11 is a view, similar to FIG. 5, but showing the configuration of the outboard motor steering system according to a third embodiment of the invention.

FIG. 11 is a view, similar to FIG. 5, but showing the configuration of the outboard motor steering system according to the third embodiment.

Similarly to the first embodiment, the ECU 22 inputs, via the inputs units 22*a*, 22*b* and 22*c*, the outputs of the steering angle sensor 30, the crank angle sensor 40 and the steered angle sensor 42 to detect or determine the steering angle θs, the engine speed NE and the steered angle θo of the outboard motor 10, calculates the desired steered wheel θod and the current supply command value at the calculation unit 22*d* such that the difference Δθ between the desired steered angle θod and the detected θo decreases to zero, and outputs and supplies the command to the electric motor 44 through the output unit 22*e* and the signal line 44L In addition, the ECU 22 inputs, via inputs unit 22*f* and input unit 22*g*, the outputs of the neutral switch 60 and the steered-direction-reversal switch (steered-angle-reversal switch) 62, and calculates the command at the calculation unit 22*d* in a manner different from the above, when any one of the neutral switch 60 and the steered-direction-reversal switch 62 generates the ON signal, as will be explained below.

The operation of the system according to the third embodiment, more specifically, the operation to control the electric motor 44 when the steered-direction-reversal switch (steered-angle-reversal switch) 62 is manipulated, will be explained with reference to a flow chart of FIG. 12. The program illustrated there is executed at prescribed intervals of, for example, 100 msec.

Explaining this, the program begins in S200 in which it is determined whether the steered-direction-reversal switch 62 generates the ON signal, i.e., it is checked if the operator manipulates the switch 62. When the result is affirmative, the program proceeds to S202 in which the engine speed NE indicative of the boat moving speed is detected (detected value is read out), and to S204 in which it is determined whether the detected engine speed NE is less than a predetermined value β, specifically, it is checked if the detected boat moving speed is less than the predetermined value. More specifically, the value β is set to a small value necessary for determining if the detected boat moving speed is low.

When the result in S204 is affirmative, the program proceeds to S206 in which the steered angle θo of the outboard motor 10 as well as its sign (+/−) is detected (detected value is read out). In this embodiment, the steered angle θo is assigned with + when the outboard motor 10 is steered left (to turn the boat 16 right), whilst the steered angle θo is assigned with − when the outboard motor 10 is steered right (to turn the boat 16 left).

The program then proceeds to S208 in which the detected steered angle θo is subtracted from a value θst to calculate a difference Δθnt. The value θst indicates an angle or direction that allows the boat 16 to move straightforward and more precisely, is an angle or direction when the steered angle θo is 0 degree. When the difference Δθnt is a positive value, it means that the outboard motor 10 is steered right. On the other hand, when the difference Δθnt is a negative value, it means that the outboard motor 10 is steered left. When the difference Δθnt is zero, it means that the steered direction is at the neutral position.

The program then proceeds to S210 in which it is checked whether the calculated difference Δθnt is zero, and when the result is negative, it proceeds to S212 in which it is determined whether the difference Δθnt is less than zero. When the result is affirmative, since this indicates that the outboard motor 10 is steered left, the program proceeds to S214 in which the electric motor 44 is controlled such that the outboard motor 10 is steered right to the maximum steered angle (i.e., 30 degrees). Thus, the steered direction of the outboard motor 10 is reversed from left to right and is steered at its maximum.

On the contrary, when the result in S212 is negative, since this indicates that the outboard motor 10 is steered right, the program proceeds to S216 in which the electric motor 44 is controlled such that the outboard motor 10 is steered left to the maximum steered angle (i.e., 30 degrees). Thus, the steered direction of the outboard motor 10 is reversed from right to left and is steered at its maximum.

When the result in S200 is negative, since this means that the operator does not input the instruction to reverse the steered direction and hence, no processing is needed, the program is immediately terminated. When the result in S204 is negative, since this indicates that the boat moving speed is not low and since it is not desirable in the sense of steering stability to change the steered angle sharply, the program is immediately terminated. In other words, the control mentioned above is made in response to the operator's instruction to reverse the steered direction only when the boat moving speed is small. When the result in S210 is affirmative, since this indicates that the steered direction is at the neutral direction and since it is not sure which direction the steered angle should be reversed, the program is immediately terminated.

In the system according to the third embodiment, since the steered-direction-reversal switch 62 is installed to be manipulated by the operator and the steered direction or angle of the outboard motor 10 is reversed in response to the operator's manipulation, the operator can easily reverse the steered direction or angle when, for example, approaching a quay to stop the boat 16, thereby enabling to lighten the burdens of the operator.

Further, since the reversal of steered direction is conducted by the maximum angle by one switch manipulation, this can further lighten the burden of the operator at the approaching operation, etc. And, since this reversal is only conducted when the boat moving speed is low, it does not degrade the steering stability.

Figure 13:
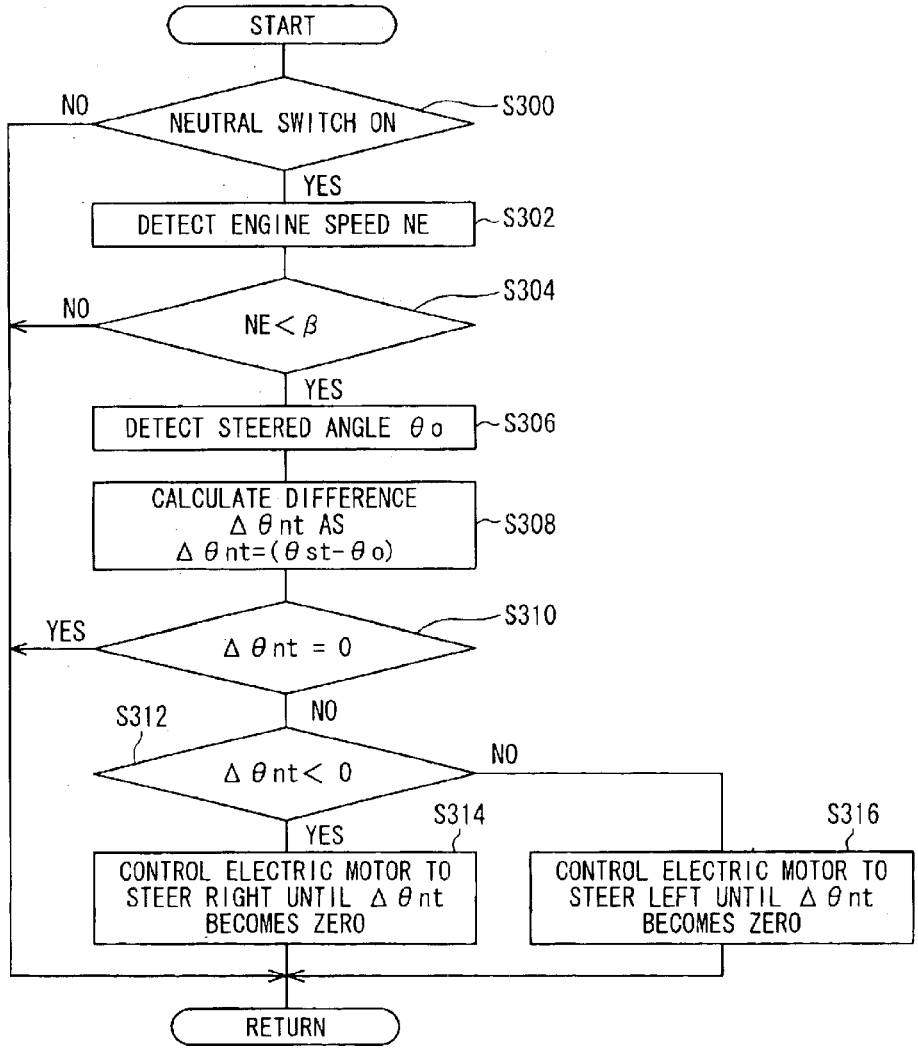
FIG. 13 is a flow chart showing another operation of the system according to the third embodiment, more specifically, the operation to control the electric motor when a neutral switch is manipulated by the operator.

Another operation of the system according to the third embodiment, more specifically, the operation to control the electric motor 44 when the neutral switch 60 is manipulated, will be explained with reference to a flow chart of FIG. 13. The program illustrated there is also executed at prescribed intervals of, for example, 100 msec.

Explaining this, the program begins in S300 in which it is determined whether the neutral switch 60 generates the ON signal, i.e., it is checked if the operator manipulates the switch 60. When the result is affirmative, the program proceeds to S302 in which the engine speed NE indicative of the boat moving speed is detected, and to S304 in which it is determined whether the detected boat moving speed is less than the predetermined value $\beta$.

When the result in S304 is affirmative, the program proceeds to S306 in which the steered angle $\theta o$ is detected, to S308 in which the difference $\Delta\theta nt$ is calculated. The program then proceeds to S310 in which it is checked whether the calculated difference $\Delta\theta nt$ is zero, and when the result is negative, it proceeds to S312 in which it is determined whether the difference $\Delta\theta nt$ is less than zero. When the result is affirmative, the program proceeds to S314 in which the electric motor 44 is controlled in such a way that the outboard motor 10 is steered right until the difference $\Delta\theta nt$ has became zero, such that the steered direction or angle of the outboard motor 10 is restored to the neutral position. On the contrary, when the result in S312 is negative, the program proceeds to S316 in which the electric motor 44 is controlled in such a way that the outboard motor 10 is steered left until the difference $\Delta\theta nt$ has became zero, such that the steered direction or angle of the outboard motor 10 is restored to the neutral position.

When the result in S300 is negative, since this means that no processing is needed, the program is immediately terminated. When the result in S304 is negative, since this indicates that the boat moving speed is not low and since it is not desirable in the sense of steering stability to change the steered angle markedly, the program is immediately terminated. In other words, the control mentioned above is made in response to the operator's instruction to restore the steered direction to the neutral position only when the boat moving speed is small. When the result in S310 is affirmative, since no processing is needed, the program is immediately terminated.

Figure 12:
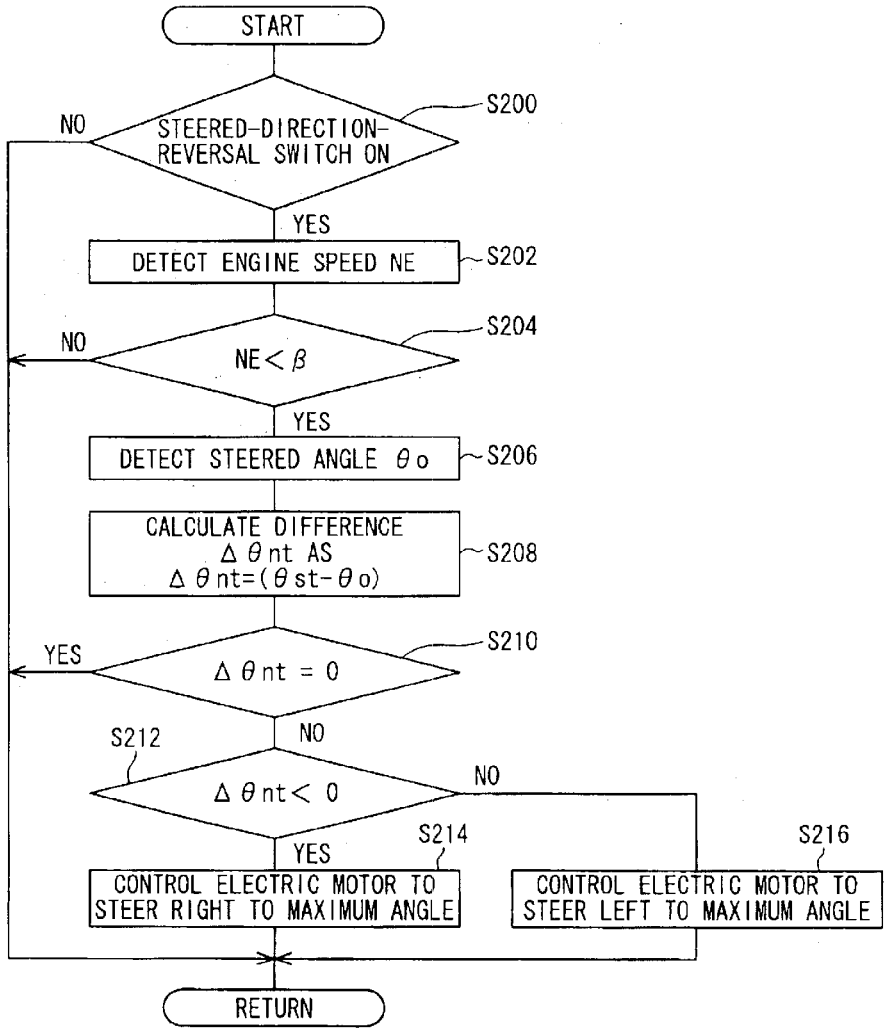
FIG. 12 is a flow chart showing the operation of the system according to the third embodiment, more specifically, the operation to control the electric motor when a steered-direction-reversal switch is manipulated by the operator.

In addition to the advantages and effects mentioned with reference to FIG. 12, in the system according to the third embodiment, since the neutral switch 60 is installed to be manipulated by the operator and the steered direction or angle of the outboard motor 10 is restored to the neutral position in response to the operator's manipulation, the operator can easily recognize that the steered direction or angle is at the neutral position. With this, the operator need not inspect it by visually checking or by moving the boat 16 slowly, when, for example, leaving a quay, thereby enabling to lighten the burden of the operator. Further, since this restoration to the neutral position is only conducted when the boat moving speed is low, it does not degrade the steering stability at a high boat moving speed.

The first and second embodiments are thus arranged to have a steering system for an outboard motor 10 mounted on a stern of a boat 16 and having an internal combustion engine 18 at its upper portion and a propeller 24 with a rudder 26 at its lower portion powered by the engine to propel and steer the boat, comprising: a steering device (steering wheel 28) installed on the boat to be manipulated by an operator; a swivel shaft 50 installed in the outboard motor and connected to the propeller to turn the propeller relative to the boat; an actuator (electric motor 44) installed in the outboard motor and connected to the swivel shaft to rotate the swivel shaft relative to the boat; a steering angle sensor 30 generating a signal indicative of a steering angle $\theta s$ inputted through the steering device by the operator; a steered angle sensor 42 generating a signal indicate of a steered angle $\theta o$ of the outboard motor; a speed sensor (crank angle sensor 40) generating a signal (a signal indicative of the engine speed NE) indicative of a moving speed of the boat; and a controller (ECU 22) connected to the actuator, the steering angle sensor, the steered angle sensor and the speed sensor, and controlling the actuator in such a manner that the steered angle $\theta o$ of the outboard motor relative to the steering angle $\theta s$ becomes a predetermined ratio determined based on the moving speed of the boat.

In the system, the predetermined ratio is changed such that the steered angle $\theta o$ of the outboard motor relative to the steering angle $\theta s$ decreases with increasing moving speed of the boat. Specifically, the predetermined ratio is changed such that the steered angle $\theta o$ of the outboard motor relative to the detected steering angle $\theta s$ decreases with increasing detected moving speed of the boat, whereby a speed of steering at a high boat moving speed is smaller than that at a low boat moving speed.

The third embodiment is thus arranged to have a steering system for an outboard motor 10 mounted on a stern of a boat 16 and having an internal combustion engine 18 at its upper portion and a propeller 24 with a rudder 26 at its lower portion powered by the engine to propel and steer the boat, comprising: a steering device (steering wheel 28) installed on the boat to be manipulated by an operator; a swivel shaft 50 installed in the outboard motor and connected to the propeller to turn the propeller relative to the boat; an actuator (electric motor 44) installed in the outboard motor and connected to the swivel shaft to rotate the swivel shaft relative to the boat; a steering angle sensor 30 generating a signal indicative of a steering angle $\theta s$ inputted through the steering wheel by the operator; a switch 60, 62 to be manipulated by the operator and generating a signal indicative of an instruction to change the steered angle of the outboard motor when manipulated; and a controller (ECU 22) connected to the actuator, the steering angle sensor and the switch, and controlling the actuator to rotate the swivel shaft so as to steer the outboard motor to an angle in response to inputted steering angle $\theta s$ when the switch is not manipulated, while controlling the actuator to change the steered angle when the switch is manipulated.

In the system, the switch is a neutral switch 60 that generates the signal indicative of the instruction to change the steered angle of the outboard motor to be restored to a neutral position that allows the boat to advance straightforward, and the controller controls the actuator to change the steered angle to the neutral position when the switch is manipulated. The system further includes: a speed sensor (crank angle sensor 40) generating an output indicative of a moving speed of the boat; and the controller inputs the output of the speed sensor and controls the actuator to change the steered angle $\theta o$ to the neutral position if the moving speed of the boat is less than a predetermined value $\beta$ when the switch is manipulated.

In the system, the switch is a steered-angle-reversal switch (steered-direction-reversal switch) 62 that generates the signal indicative of the instruction to change the steered angle θo of the outboard motor in a reversed direction that allows the boat to turn in an opposite direction, and the controller controls the actuator to change the steered angle θo to the reverse direction when the switch is manipulated. The system further includes: a speed sensor (crank angle sensor 40) generating an output indicative of a moving speed of the boat; and the controller inputs the output of the speed sensor and controls the actuator to change the steered angle to the reverse direction if the moving speed of the boat is less than a predetermined value β when the switch is manipulated. The controller controls the actuator to change the steered angle to the reverse direction to a maximum angle (30 degrees) when the switch is manipulated.

It should be noted in the above that, although the electric motor 44 is used as an actuator to rotate the swivel shaft 50 to steer the outboard motor 10, the invention should not be limited thereto and other actuators such as a hydraulic actuator may instead be used.

It should also be noted in the above that, although the boat moving speed is detected from the engine speed NE, it is alternatively possible to install a sensor that can directly senses the boat moving speed.

The entire disclosure of Japanese Patent Application No. 2003-010047 filed on Jan. 17, 2003, and Japanese Patent Application No. 2003-049862 filed on Feb. 26, 2003, including specification, claims, drawings and summary, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A steering system for an outboard motor mounted on a stern of a boat and having an internal combustion engine at its upper portion and a propeller with a rudder at its lower portion powered by the engine to propel and steer the boat, comprising:

a steering device installed on the boat to be manipulated by an operator;

a swivel shaft installed in the outboard motor and connected to the propeller to turn the propeller relative to the boat;

an actuator installed in the outboard motor and connected to the swivel shaft to rotate the swivel shaft relative to the boat;

a steering angle sensor generating a signal indicative of a steering angle inputted through the steering device by the operator;

a steered angle sensor generating a signal indicative of a steered angle of the outboard motor;

a speed sensor generating a signal indicative of a moving speed of the boat; and a controller connected to the actuator, the steering angle sensor, the steered angle sensor and the speed sensor, and controlling the actuator in such a manner that the steered angle of the outboard motor relative to the steering angle becomes a predetermined ratio determined based on the moving speed of the boat.

2. A system according to claim 1, wherein the predetermined ratio is changed such that the steered angle of the outboard motor relative to the steering angle decreases with increasing moving speed of the boat.

3. A system according to claim 2, wherein the predetermined ratio is changed such that the steered angle of the outboard motor relative to the steering angle decreases with increasing moving speed of the boat, whereby a speed of steering at a high boat moving speed is smaller than that at a low boat moving speed.

4. A steering system for an outboard motor mounted on a stern of a boat and having an internal combustion engine at its upper portion and a propeller with a rudder at its lower portion powered by the engine to propel and steer the boat, comprising:

a steering device installed on the boat to be manipulated by an operator;

a swivel shaft installed in the outboard motor and connected to the propeller to turn the propeller relative to the boat;

an actuator installed in the outboard motor and connected to the swivel shaft to rotate the swivel shaft relative to the boat;

a steering angle sensor generating a signal indicative of a steering angle inputted through the steering wheel by the operator;

a switch to be manipulated by the operator and generating a signal indicative of an instruction to change the steered angle of the outboard motor when manipulated; and a controller connected to the actuator, the steering angle sensor and the switch, and controlling the actuator to rotate the swivel shaft so as to steer the outboard motor to an angle in response to inputted steering angle when the switch is not manipulated, while controlling the actuator to change the steered angle when the switch is manipulated.

5. A system according to claim 4, wherein the switch is a neutral switch that generates the signal indicative of the instruction to change the steered angle of the outboard motor to be restored to a neutral position that allows the boat to advance straightforward, and the controller controls the actuator to change the steered angle to the neutral position when the switch is manipulated.

6. A system according to claim 5, further including a speed sensor generating an output indicative of a moving speed of the boat;

and the controller inputs the output of the speed sensor and controls the actuator to change the steered angle to the neutral position if the moving speed of the boat is less than a predetermined value when the switch is manipulated.

7. A system according to claim 4, wherein the switch is a steered-angle-reversal switch that generates the signal indicative of the instruction to change the steered angle of the outboard motor in a reversed direction that allows the boat to turn in an opposite direction, and the controller controls the actuator to change the steered angle to the reverse direction when the switch is manipulated.

8. A system according to claim 7, further including a speed sensor generating an output indicative of a moving speed of the boat;

and the controller inputs the output of the speed sensor and controls the actuator to change the steered angle to the reverse direction if the moving speed of the boat is less than a predetermined value when the switch is manipulated.

9. A system according to claim 7, wherein the controller controls the actuator to change the steered angle to the reverse direction to a maximum angle when the switch is manipulate.

* * * * *